US008962963B1

(12) United States Patent
Chen

(10) Patent No.: US 8,962,963 B1
(45) Date of Patent: Feb. 24, 2015

(54) SHAPE ADJUSTABLE TAMBOURINE

(71) Applicant: Wen-Long Chen, Taichung (TW)

(72) Inventor: Wen-Long Chen, Taichung (TW)

( * ) Notice: Subject to any disclaimer, the term of this patent is extended or adjusted under 35 U.S.C. 154(b) by 0 days.

(21) Appl. No.: 14/150,820

(22) Filed: Jan. 9, 2014

(51) Int. Cl.
*G10D 13/02* (2006.01)
*G10D 13/06* (2006.01)

(52) U.S. Cl.
CPC ..... *G10D 13/06* (2013.01); *G10D 13/02* (2013.01)
USPC ..... 84/418

(58) Field of Classification Search
CPC ..... G10D 13/02
See application file for complete search history.

(56) References Cited

U.S. PATENT DOCUMENTS

| | | | | | |
|---|---|---|---|---|---|
| 5,040,446 | A | * | 8/1991 | Cohen et al. | 84/418 |
| D336,488 | S | * | 6/1993 | Grey | D17/22 |
| D446,238 | S | * | 8/2001 | Grey | D17/22 |
| D543,579 | S | * | 5/2007 | Taninbaum et al. | D17/22 |

* cited by examiner

*Primary Examiner* — Robert W Horn

(57) ABSTRACT

A tambourine is provided with a crescent shell including two tubular segment elements at both ends respectively, through holes, and two sets of two spaced grooves each extending from either end of one tubular segment element; two curved mounting members each including two groups of two spaced tubular segment members at both ends respectively, each tubular segment member including two sets of projections on an outer surface; a curved handgrip including two tubular segment unit at both ends respectively, and two collections of two spaced depressions each extending from either end of one tubular segment unit; and jingle discs each pivotably disposed in the through hole. The mounting members are pivotably secured to both ends of the shell and the handgrip is pivotably secured to both ends of the mounting members.

7 Claims, 9 Drawing Sheets

SHAPE ADJUSTABLE TAMBOURINE

BACKGROUND OF THE INVENTION

1. Field of the Invention

The invention relates to tambourines and more particularly to a tambourine having hinged mounting members and handgrip so that the tambourine can be adjusted to a circular shape or crescent shape in use, or adjusted to a compact crescent shape when not in use.

2. Description of Related Art

Tambourine is a musical instrument in the percussion family. It typically includes a frame made of wood or plastic, and a plurality of pairs of small metal jingles. Conventionally, a tambourine further includes a drumhead. Tambourines are often used with regular percussion sets.

A conventional tambourine A is shown in FIG. 6 and is circular. It can make musical sounds due to, in part of, large area. Another conventional tambourine B is shown in FIG. 7 and is crescent. Its advantages include being labor saving and portable.

It is often that both of above tambourines are carried by a musician or dancer. However, it is also often that only one of the above tambourines can be carried due to insufficient space in shipment. Thus, the need for improvement still exists.

SUMMARY OF THE INVENTION

It is therefore one object of the invention to provide a tambourine comprising a crescent shell comprising two tubular segment elements at both ends respectively, a plurality of curved through holes, and two sets of two spaced grooves each extending from either end of one of the tubular segment elements; two curved mounting members each comprising first and second groups of two spaced tubular segment members formed at both ends of the mounting member respectively, each of two ends of the tubular segment members including two sets of a plurality of lengthwise projections on an outer surface; a curved handgrip comprising two tubular segment unit at both ends respectively, and two collections of two spaced depressions each extending from either end of one of the tubular segment units; and a plurality of jingle discs each pivotably disposed in one of the through holes; wherein each of the tubular segment elements is disposed between the corresponding two tubular segment members, is in an axial alignment with the corresponding two tubular segment members, and is pivotal relative to each other; wherein one projections of each of the mounting members are disposed in the corresponding grooves to be in moveable mesh engagement therewith; wherein each of the tubular segment units is disposed between the corresponding two tubular segment members, is in an axial alignment with the corresponding two tubular segment members, and is pivotal relative to each other; and wherein other projections of each of the mounting members are disposed in the corresponding depressions to be in moveable mesh engagement therewith.

The above and other objects, features and advantages of the invention will become apparent from the following detailed description taken with the accompanying drawings.

DETAILED DESCRIPTION OF THE INVENTION

Figure 1:
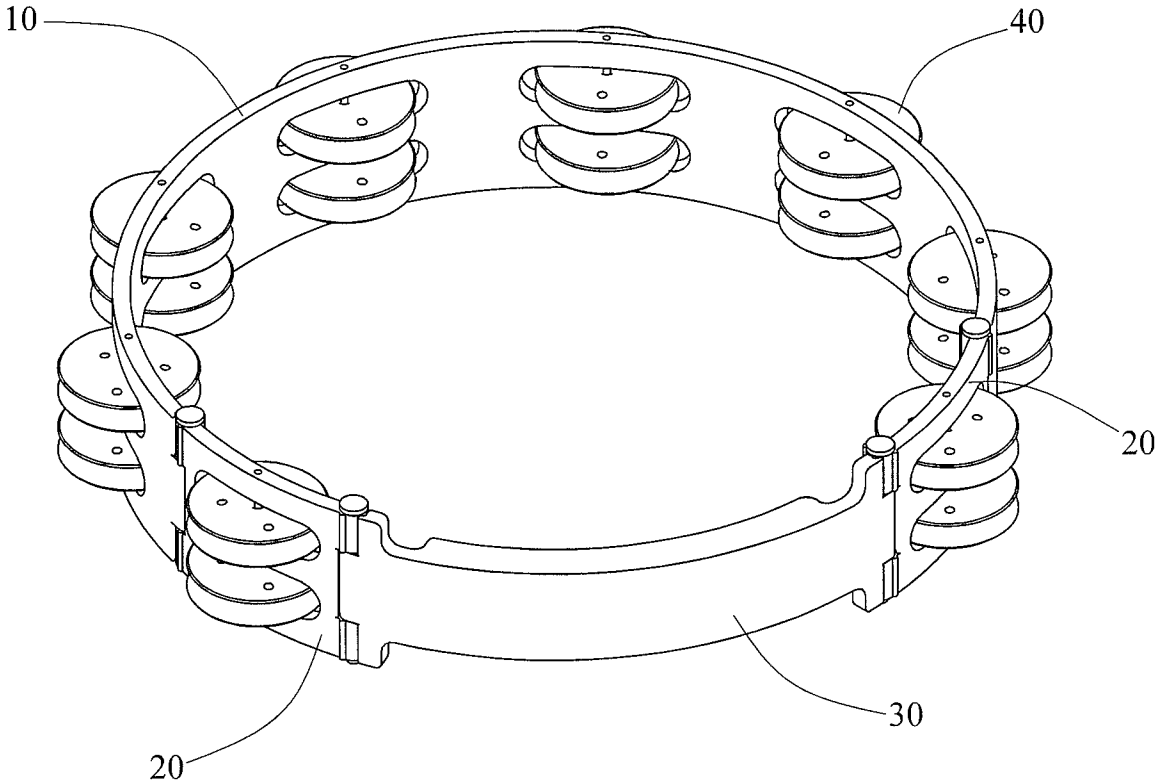
FIG. 1 is a perspective view of a tambourine according to the invention.
Figure 2:
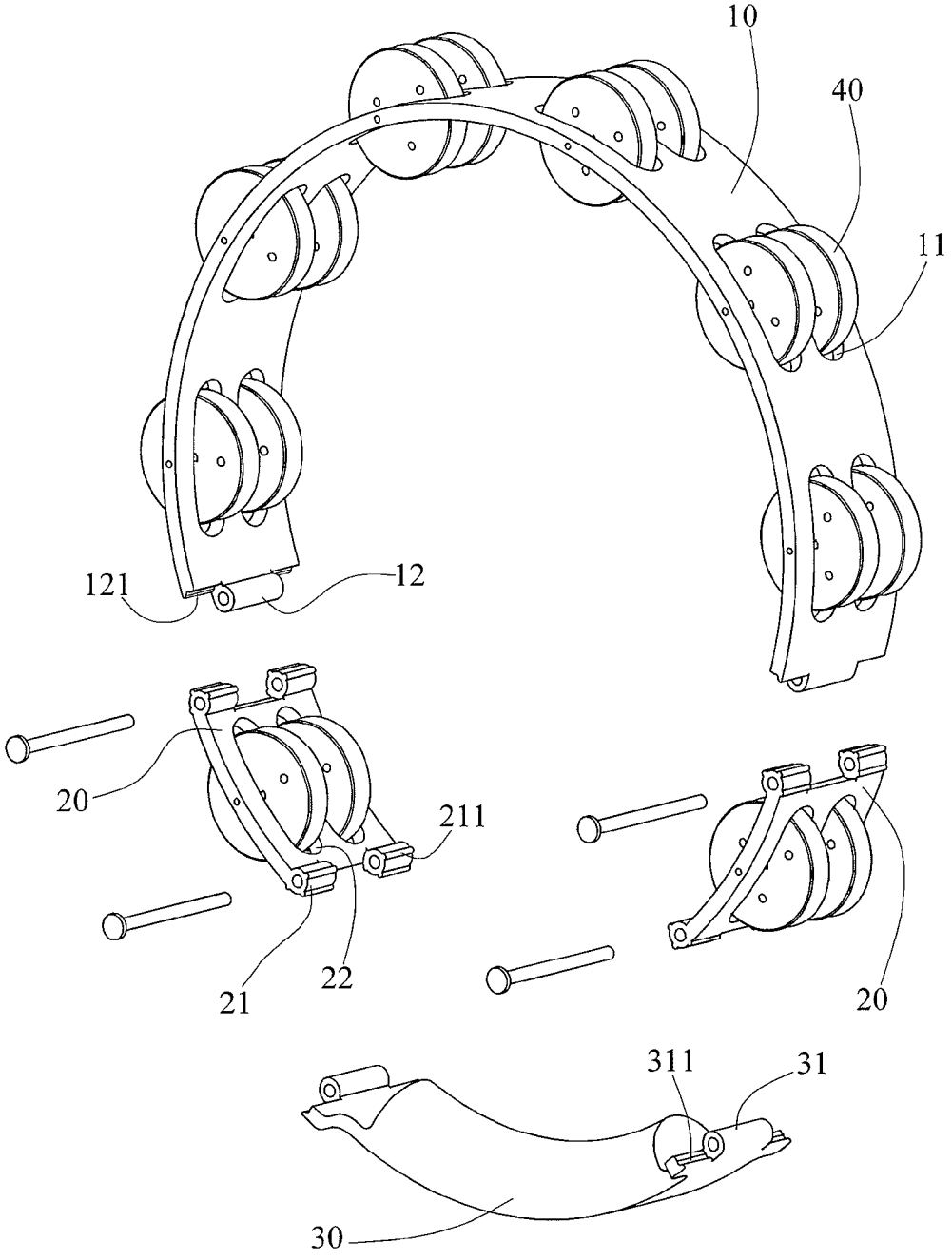
FIG. 2 is an exploded view of the tambourine.

Referring to FIGS. 1 to 5, a tambourine in accordance with the invention comprises the following components as discussed in detail below.

A crescent shell 10 comprises a plurality sets of two parallel curved through holes 11, two tubular segments 12 at both ends respectively, and two sets of two spaced grooves 121 wherein each groove 121 of either set extends from either end of the tubular segment 12 to either edge of the shell 10.

Two curved mounting members 20 each comprise two sets of two spaced tubular segments 21 which each set of the tubular segments 21 are formed at either end of the mounting member 20. Each mounting member 20 further comprises two parallel curved through holes 22 between both ends. The tubular segment 21 comprises three lengthwise projections 211 on an outer surface. Specifically, the projections 211 are formed at three corners of a substantially rectangular surface of the tubular segment 21 when viewing from an angle directly facing the mounting member 20. That is, the projections 211 are formed at three vertices of a virtual L-shaped line respectively.

A curved handgrip 30 served as a handle comprises two tubular segments 31 at both ends respectively, and two sets of two spaced depressions 311 wherein each depression 311 of either set extends from either end of the tubular segment 31 and projects a short distance out of either side of the handgrip 30. A plurality of jingle discs 40 each pivotably disposes in the through hole 11 or 22.

The tubular segment 12 is disposed in a gap between two adjacent tubular segments 21 so as to mesh in axial alignment therewith. Also, one of the projections 211 is disposed in the corresponding groove 121 to be in mesh engagement therewith. Likewise, the tubular segment 31 is disposed in a gap between two adjacent tubular segments 21 so as to mesh in axial alignment therewith. Also, one of the projections 211 is disposed in the corresponding depression 311 to be in mesh engagement therewith. A plurality of pins (not numbered) each is inserted through the tubular segments 21 and 12, or the tubular segments 21 and 31 to effectively couple the mounting members 20 and the shell 10 (or the mounting members 20 and the handgrip 30) so that they are movable relative to each other about a common axis defined by the pin.

A plurality of use positions of the tambourine are illustrated in FIGS. 3A to 5.

Figure 3A:
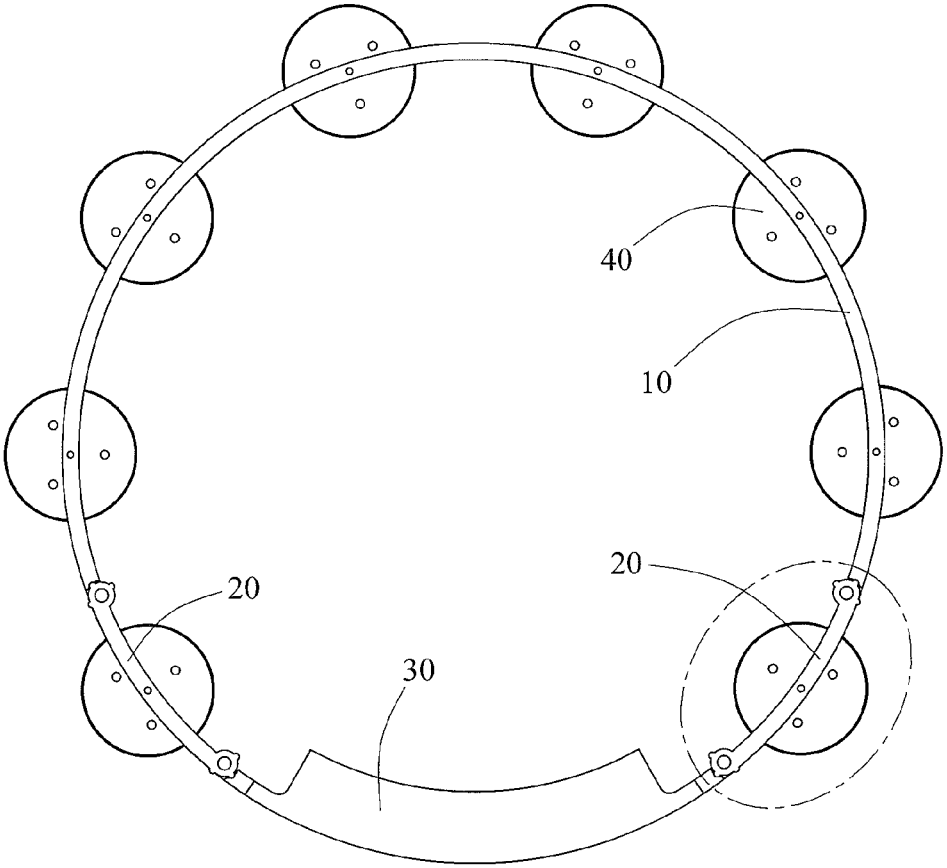
FIG. 3A is a top view of the tambourine showing a first use position.
Figure 3A:
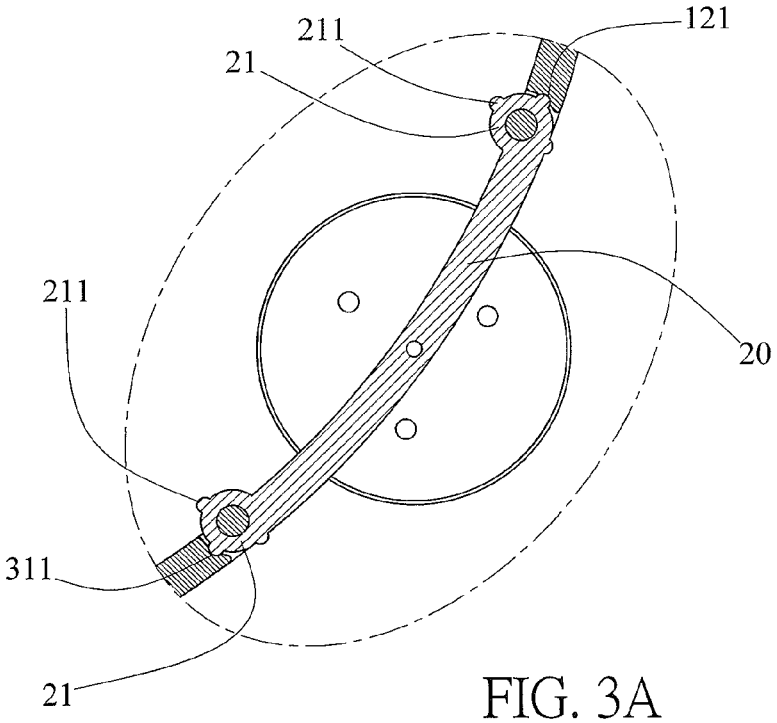

In FIG. 3A, two projections 211 at one end of the mounting member 20 are disposed in the corresponding grooves 121 to be in mesh engagement therewith, and two projections 211 at the other end of the mounting member 20 are disposed in the corresponding depressions 311 to be in mesh engagement therewith. A circular tambourine (i.e., a first shape) is thus formed.

Figure 3B:
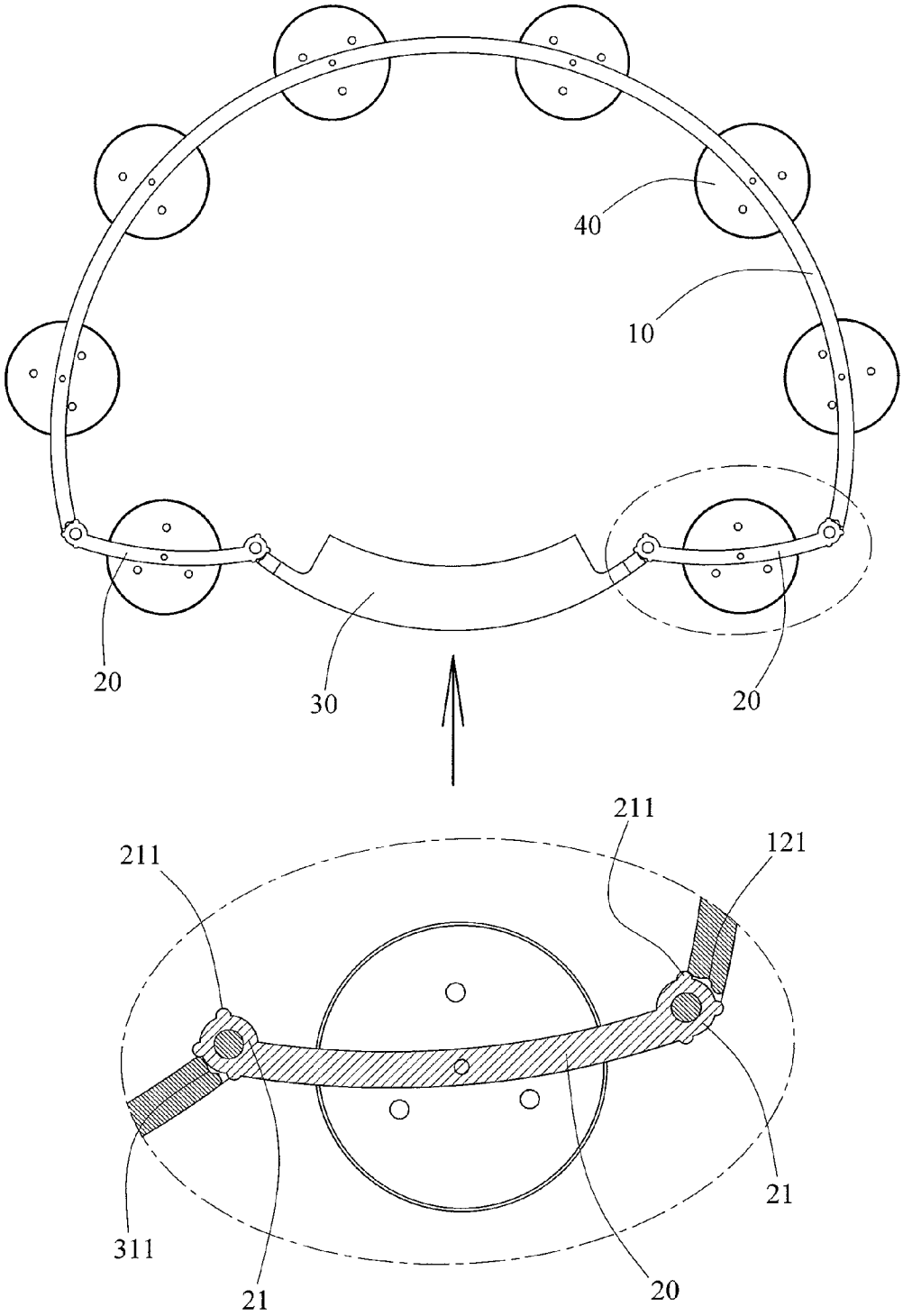
FIG. 3B is a view similar to FIG. 3A showing a second use position.

In FIG. 3B, a user may push an intermediate portion of the handgrip 30 inward to clear the projections 211 out of the grooves 121 and depressions 311 when transforming the tambourine into a desired shape as detailed below.

Figure 3C:
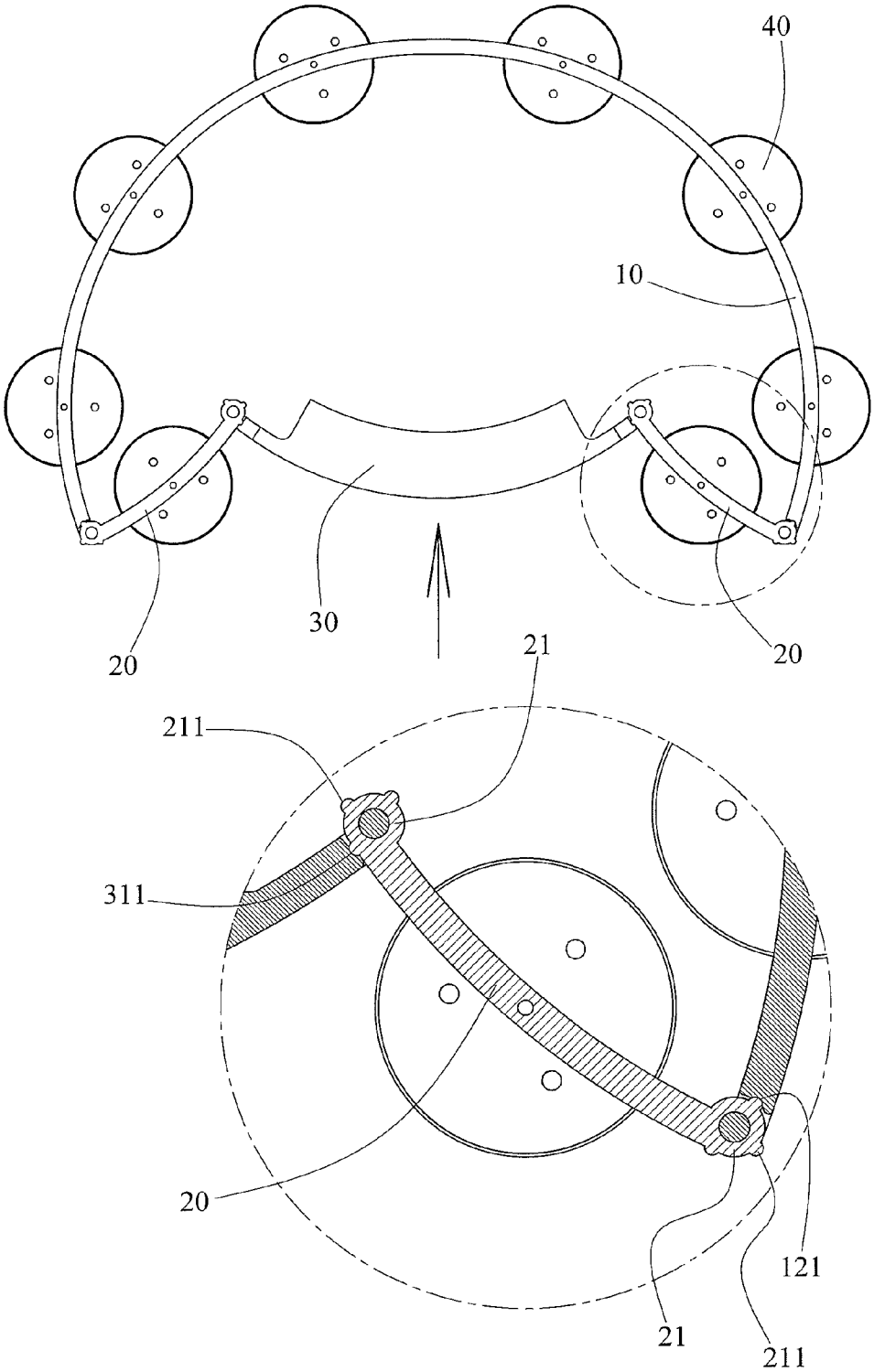
FIG. 3C is a view similar to FIG. 3A showing a third use position.

In FIG. 3C, as an immediately next step, another two projections 211 at one end of the mounting member 20 are disposed in the corresponding grooves 121 to be in mesh engagement therewith, and another two projections 211 at the other end of the mounting member 20 are disposed in the corresponding depressions 311 to be in mesh engagement therewith. A crescent tambourine (i.e., a second shape) is thus formed.

Figure 4:
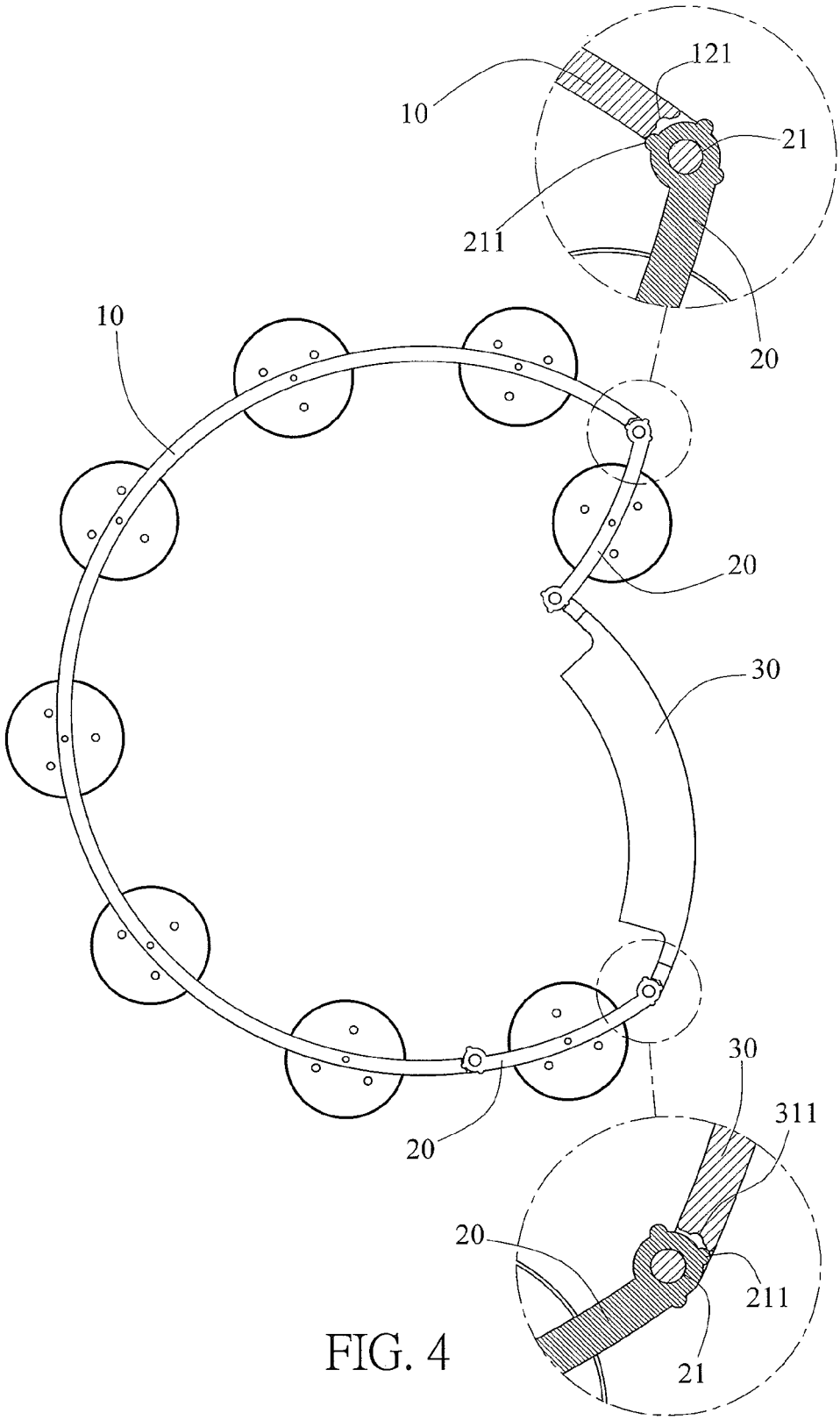
FIG. 4 is a view similar to FIG. 3A showing a fourth use position.

Similarly, the user may push one end of the handgrip 30 inward to transform the tambourine into a third shape as shown in FIG. 4.

Figure 5:
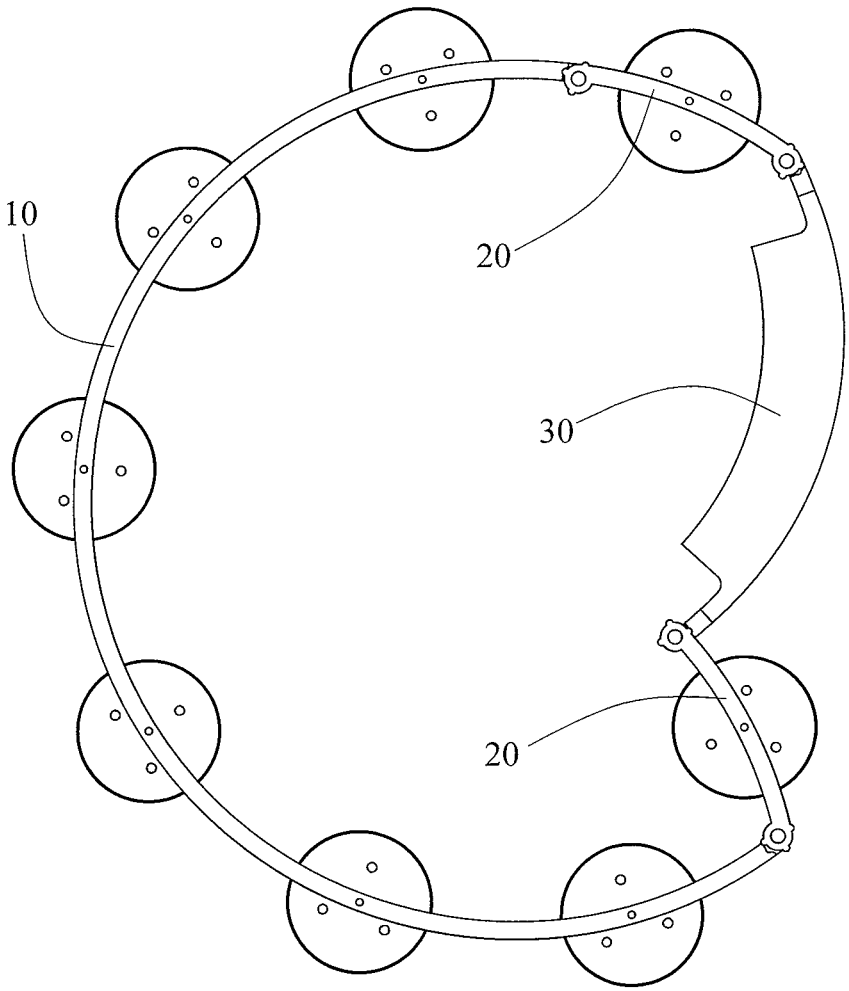
FIG. 5 is a view similar to FIG. 3A showing a fifth use position.
Figure 6:
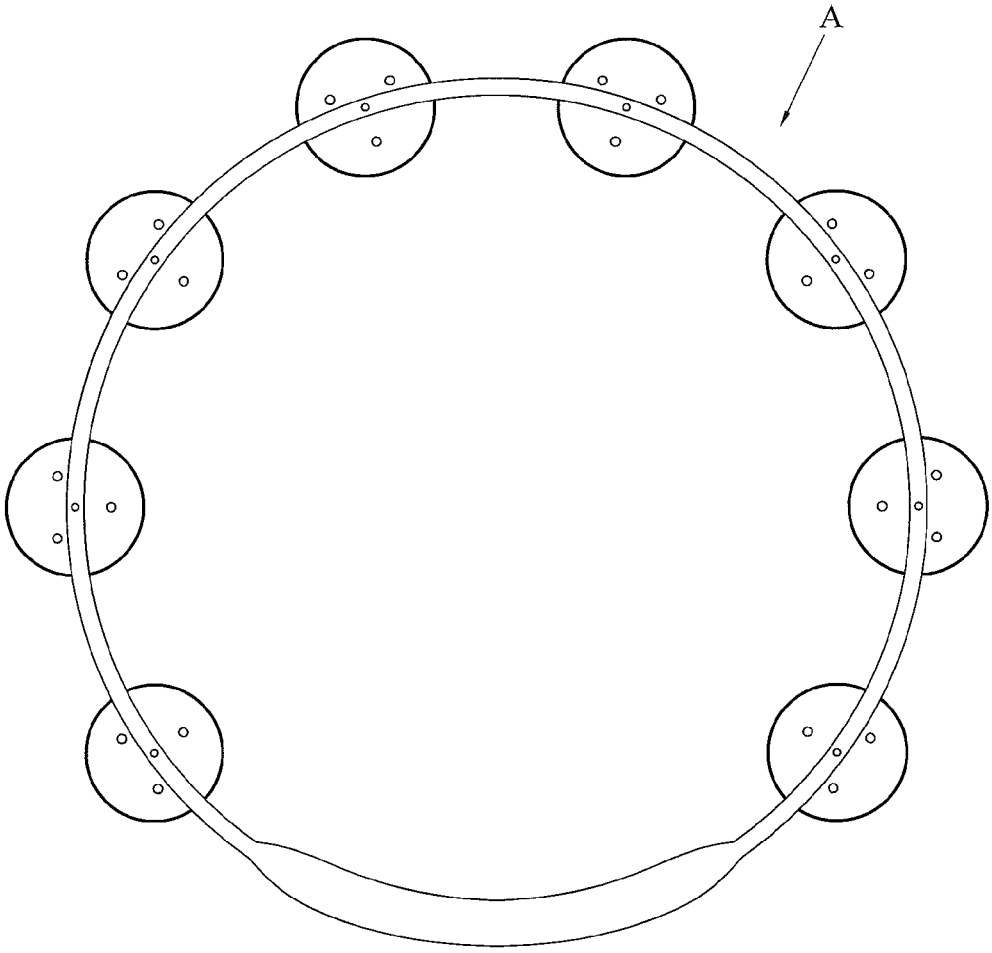
FIG. 6 Prior Art
FIG. 6 is a top view of a conventional tambourine.
Figure 7:
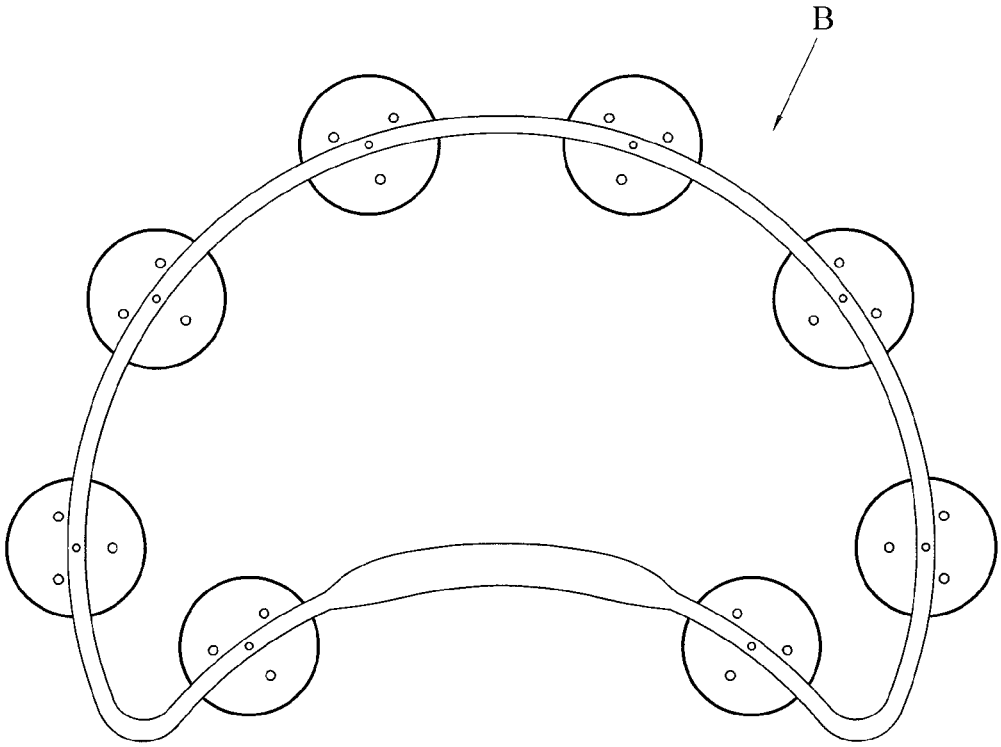
FIG. 7 Prior Art
FIG. 7 is a top view of another conventional tambourine.

Still similarly, the user may push the other end of the handgrip 30 inward to transform the tambourine into a fourth shape as shown in FIG. 5.

It is envisaged by the invention that very pleasing sounds can be produced by the jingle discs 40 when the tambourine is shaken.

It is further envisaged by the invention that the tambourine can be adjusted to form one of the above shapes depending on applications. Further, the tambourine can be adjusted to form a compact crescent shape for saving space when not in use.

While the invention has been described in terms of preferred embodiments, those skilled in the art will recognize that the invention can be practiced with modifications within the spirit and scope of the appended claims.

What is claimed is:

1. A tambourine comprising:

a crescent shell comprising two tubular segment elements at both ends respectively, a plurality of curved through holes, and two sets of two spaced grooves each extending from either end of one of the tubular segment elements;

two curved mounting members each comprising first and second groups of two spaced tubular segment members formed at both ends of the mounting member respectively, each of two ends of the tubular segment members including two sets of a plurality of lengthwise projections on an outer surface;

a curved handgrip comprising two tubular segment unit at both ends respectively, and two collections of two spaced depressions each extending from either end of one of the tubular segment units; and a plurality of jingle discs each pivotably disposed in one of the through holes;

wherein each of the tubular segment elements is disposed between the corresponding two tubular segment members, is in an axial alignment with the corresponding two tubular segment members, and is pivotal relative to each other;

wherein one projections of each of the mounting members are disposed in the corresponding grooves to be in moveable mesh engagement therewith;

wherein each of the tubular segment units is disposed between the corresponding two tubular segment members, is in an axial alignment with the corresponding two tubular segment members, and is pivotal relative to each other; and wherein other projections of each of the mounting members are disposed in the corresponding depressions to be in moveable mesh engagement therewith.

2. The tambourine of claim 1, wherein the through holes are parallel.

3. The tambourine of claim 1, wherein each of the mounting members further comprises two curved through hole members.

4. The tambourine of claim 3, wherein the through hole members are parallel.

5. The tambourine of claim 2, wherein an angle of one projection of each of the sets with respect to an adjacent projection of the same set is 90-degree.

6. The tambourine of claim 3, wherein an angle of one projection of each of the sets with respect to an adjacent projection of the same set is 90-degree.

7. The tambourine of claim 4, wherein an angle of one projection of each of the sets with respect to an adjacent projection of the same set is 90-degree.

* * * * *